US010266356B2

(12) United States Patent
Yanagida et al.

(10) Patent No.: US 10,266,356 B2
(45) Date of Patent: Apr. 23, 2019

(54) PAPER SHEET STORAGE DEVICE AND PAPER SHEET STORAGE METHOD

(71) Applicant: FUJITSU FRONTECH LIMITED, Inagi (JP)

(72) Inventors: Hiroshi Yanagida, Inagi (JP); Daiki Harai, Inagi (JP); Ryo Fujiwara, Inagi (JP); Tomoyuki Tamahashi, Inagi (JP); Koichi Hosoyama, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/636,948

(22) Filed: Jun. 29, 2017

(65) Prior Publication Data

US 2017/0297842 A1 Oct. 19, 2017

Related U.S. Application Data

(63) Continuation of application No. PCT/JP2015/050536, filed on Jan. 9, 2015.

(51) Int. Cl.
*G07D 11/00* (2006.01)
*B65H 5/28* (2006.01)
(Continued)

(52) U.S. Cl.
CPC ..... *B65H 5/28* (2013.01); *B65H 26/06* (2013.01); *B65H 26/063* (2013.01);
(Continued)

(58) Field of Classification Search
CPC ..... B65H 26/08; B65H 26/06; B65H 26/063; B65H 26/066; B65H 29/006; B65H 29/008; B65H 29/12; B65H 5/28; B65H 43/08; B65H 2301/4191; B65H 2701/1912; B65H 2401/221; B65H 2401/222;
(Continued)

(56) References Cited

U.S. PATENT DOCUMENTS 7,490,823 B2 2/2009 Oishi et al.
9,604,812 B2 * 3/2017 Hata ..... B65H 5/28
(Continued)

FOREIGN PATENT DOCUMENTS

EP 1710181 10/2006
JP 58-195369 12/1983
(Continued)

OTHER PUBLICATIONS

International Search Report dated Apr. 7, 2015 in corresponding International Application No. PCT/JP2015/050536.
(Continued)

*Primary Examiner* — Jeffrey A Shapiro
(74) *Attorney, Agent, or Firm* — Staas & Halsey LLP

(57) ABSTRACT

A paper sheet storage device includes a supply reel that supplies a rolled tape; a winding drum around which a banknote is wound together with the tape supplied from the supply reel; a first detection unit that detects a supply amount of the tape supplied from the supply reel; and a second detection unit that detects the winding drum of which the outer diameter becomes equal to or larger than a predetermined outer diameter when the banknote is wound around the winding drum together with the tape.

4 Claims, 12 Drawing Sheets

(51) Int. Cl.

| | |
|---|---|
| ***B65H 26/08*** | (2006.01) |
| ***B65H 26/06*** | (2006.01) |
| ***B65H 29/12*** | (2006.01) |
| ***B65H 29/00*** | (2006.01) |
| ***B65H 43/08*** | (2006.01) |

(52) U.S. Cl.
CPC ..... *B65H 26/066* (2013.01); *B65H 26/08* (2013.01); *B65H 29/006* (2013.01); *B65H 29/008* (2013.01); *B65H 29/12* (2013.01); *B65H 43/08* (2013.01); *G07D 11/00* (2013.01); *G07D 11/0003* (2013.01); *G07D 11/0006* (2013.01); *G07D 11/0018* (2013.01); *G07D 11/0021* (2013.01); *G07D 11/0024* (2013.01); *G07D 11/0027* (2013.01); *G07D 11/0033* (2013.01); *G07D 11/0036* (2013.01); *G07D 11/0045* (2013.01); *B65H 2301/4191* (2013.01); *B65H 2401/221* (2013.01); *B65H 2401/222* (2013.01); *B65H 2511/142* (2013.01); *B65H 2515/60* (2013.01); *B65H 2553/612* (2013.01); *B65H 2701/1912* (2013.01)

(58) Field of Classification Search
CPC ..... B65H 2511/142; B65H 2515/60; B65H 2553/612; G07D 11/00; G07D 11/0003; G07D 11/0006; G07D 11/0018; G07D 11/0021; G07D 11/0024; G07D 11/0027; G07D 11/0033; G07D 11/0036; G07D 11/0045; G07D 2211/00
USPC ..... 194/206, 207; 235/379; 209/534; 271/176, 216; 242/333.5, 334.5, 364.7, 242/364.8, 413.2, 419.2, 421.4, 528
See application file for complete search history.

(56) References Cited

U.S. PATENT DOCUMENTS

2006/0225986 A1* 10/2006 Oishi ..... B65H 5/28 194/203
2010/0163571 A1* 7/2010 Mizoro ..... B65H 29/006 221/71
2013/0081922 A1* 4/2013 Amo ..... B65H 29/006 194/206
2014/0090949 A1* 4/2014 Suetaka ..... B65H 5/28 194/206
2015/0048197 A1* 2/2015 Hata ..... B65H 5/28 242/528

FOREIGN PATENT DOCUMENTS

| | | |
|---|---|---|
| JP | S58195369 | 12/1983 |
| JP | 8-268617 | 10/1996 |
| JP | 11-224362 | 8/1999 |
| JP | 2001122470 | 5/2001 |
| JP | 2006-69708 | 3/2006 |
| JP | 2006-290513 | 10/2006 |
| JP | WO2011/155019 | 12/2011 |
| JP | 2013-137619 | 7/2013 |
| WO | WO 2010/052795 A1 | 5/2010 |
| WO | WO2011036782 | 3/2011 |

OTHER PUBLICATIONS

Written Opinion Of The International Searching Authority dated Apr. 7, 2015 in corresponding International Application No. PCT/JP2015/050536.
Office Action dated Feb. 5, 2018, in corresponding Chinese Patent Application No. 201580072188.3, 14 pgs.
Extended European Search Report, dated Dec. 22, 2017, in European Application No. 15876886.1 (8 pp).
Japanese Office Action dated May 29, 2018, in corresponding Japanese Patent Application No. 2016-568253, 4 pgs.
2nd Notification of Office Action, dated Oct. 9, 2018, in Chinese Application No. 201580072188.3 (16 pp.).

* cited by examiner

PAPER SHEET STORAGE DEVICE AND PAPER SHEET STORAGE METHOD

CROSS-REFERENCE TO RELATED APPLICATION

This application is a continuation application of International Application PCT/JP2015/050536, filed on Jan. 9, 2015 and designating the U.S., the entire contents of which are incorporated herein by reference.

FIELD

The present invention relates to a paper sheet storage device and a paper sheet storage method.

BACKGROUND

A banknote handling device such as an automated teller machine (ATM) includes a banknote storage device that temporarily stores loaded banknotes. In this type of banknote storage device, banknotes are stored by winding banknotes around a winding drum together with a tape supplied from a supply reel.

Patent Literature 1: Japanese Laid-open Patent Publication No. 2013-137619

Patent Literature 2: Japanese Laid-open Patent Publication No. H11-224362

Patent Literature 3: Re-publication of PCT International Publication No. 2010-052795

FIG. 12A is a schematic side view for describing a state in which a winding drum winds banknotes together with a tape in a banknote storage device according to a related art of the present application. FIG. 12B is a schematic side view for describing a state in which a supply reel rewinds a tape in the banknote storage device according to a related art of the present application.

However, as illustrated in FIGS. 12A and 12B, a configuration in which a conveying path of a tape is disposed to pass near an outer diameter of a winding drum is proposed in order to reduce the entire size of a banknote storage device. As illustrated in FIG. 12A, a banknote storage device 111 includes a supply reel 112, a winding drum 113, and a detection unit 116. The supply reel 112 supplies a rolled tape 114 along a conveying path formed by a plurality of guide rollers 118. The winding drum 113 rotates in a counter-clockwise direction in FIG. 12A to wind banknotes together with the tape 114 supplied from the supply reel 112. In this case, banknotes are loaded from a conveying port 121 in a state of being sandwiched between a pinch roller 122 that forms the conveying path of the tape 114 and a guide roller 124 having a guide member 123. Banknotes loaded from the conveying port 121 are guided toward the space between the tape 114 wound around the winding drum 113 and a circumferential surface of the winding drum 113. The detection unit 116 detects a supply amount of the tape 114 supplied from the supply reel 112. The detection unit 116 includes a light emitting unit 116*a* that emits detection light to the tape 114 supplied from the supply reel 112 and a light receiving unit 116*b* that receives the detection light. The light emitting unit 116*a* and the light receiving unit 116*b* are disposed at positions at which the units face each other with the conveying path of the tape 114 interposed therebetween.

The banknote storage device 111 stores banknotes by winding banknotes around the winding drum 113 together with the tape 114 and then rotates the supply reel 112 in the counter-clockwise direction in FIG. 12B to thereby rewind the tape 114 wound around the winding drum 113. The banknote storage device 111 discharges the banknotes wound around the winding drum 113 together with the tape 114 from the conveying port 121 by rewinding the tape 114 around the supply reel 112.

FIG. 13A is a schematic side view for describing a state in which a starting end of a tape is detected in the banknote storage device according to the related art of the present application. FIG. 13B is a schematic side view for describing a state in which a terminal end of a tape is detected on a banknote storage device according to the related art of the present application.

As illustrated in FIGS. 13A and 13B, the tape 114 used in the banknote storage device 111 is formed of a resin film having a light transmitting property and a light blocking film is formed in a starting end 132 and a terminal end 133 in a longitudinal direction (the direction A) of the tape 114. The detection unit 116 detects the starting end 132 and the terminal end 133 in such a way that the detection light received by the light receiving unit 116*b* is blocked when the starting end 132 and the terminal end 133 of the tapes 114 enter between the light emitting unit 116*a* and the light receiving unit 116*b*. In this way, the banknote storage device 111 calculates a winding amount of the tape 114 wound around the winding drum 113. The banknote storage device 111 counts the number of banknotes stored in a state of being wound around the winding drum 113 by performing a predetermined calculation process based on the winding amount of the tape 114.

FIG. 13C is a schematic side view for describing a state in which the winding drum 113 of which the outer diameter becomes equal to or larger than a predetermined winding diameter interferes with the conveying path of the tape 114 in the banknote storage device 111 according to the related art of the present application.

However, when a folded banknote or a wrinkled banknote (hereinafter referred to as a worn-out banknote) is wound around the winding drum 113, the winding diameter of the winding drum 113 may become equal to or larger than an expected winding diameter. In such a case, as illustrated in FIG. 13C, the winding drum 113 may interfere with the conveying path of the tape 114 or another constituent member such as the guide member 123. That is, the winding drum 113 may interfere with the conveying path of the tape 114, the guide member 123, or the like before the detection unit 116 detects the terminal end 133 of the tape 114. As a result, the tape 114, the winding drum 113, and the other constituent member may be damaged or broken and the reliability of a winding operation of the winding drum 113 may become poor.

SUMMARY

According to an aspect of the embodiments, a paper sheet storage device includes: a supply reel that supplies a rolled belt-like member; a winding drum around which a paper sheet is wound together with the belt-like member supplied from the supply reel; a first detection unit that detects a supply amount of the belt-like member supplied from the supply reel; and a second detection unit that detects the winding drum of which the outer diameter becomes equal to or larger than a predetermined outer diameter when the paper sheet is wound around the winding drum together with the belt-like member.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, a banknote storage device and a banknote storage method according to an embodiment, related to a paper sheet storage device and a paper sheet storage method disclosed in the present application will be described in detail based on the drawings. The paper sheet storage device and the paper sheet storage method disclosed in the present application are not limited to the following embodiments.

First Embodiment

[Configuration of Banknote Handling Device]

Figure 1:
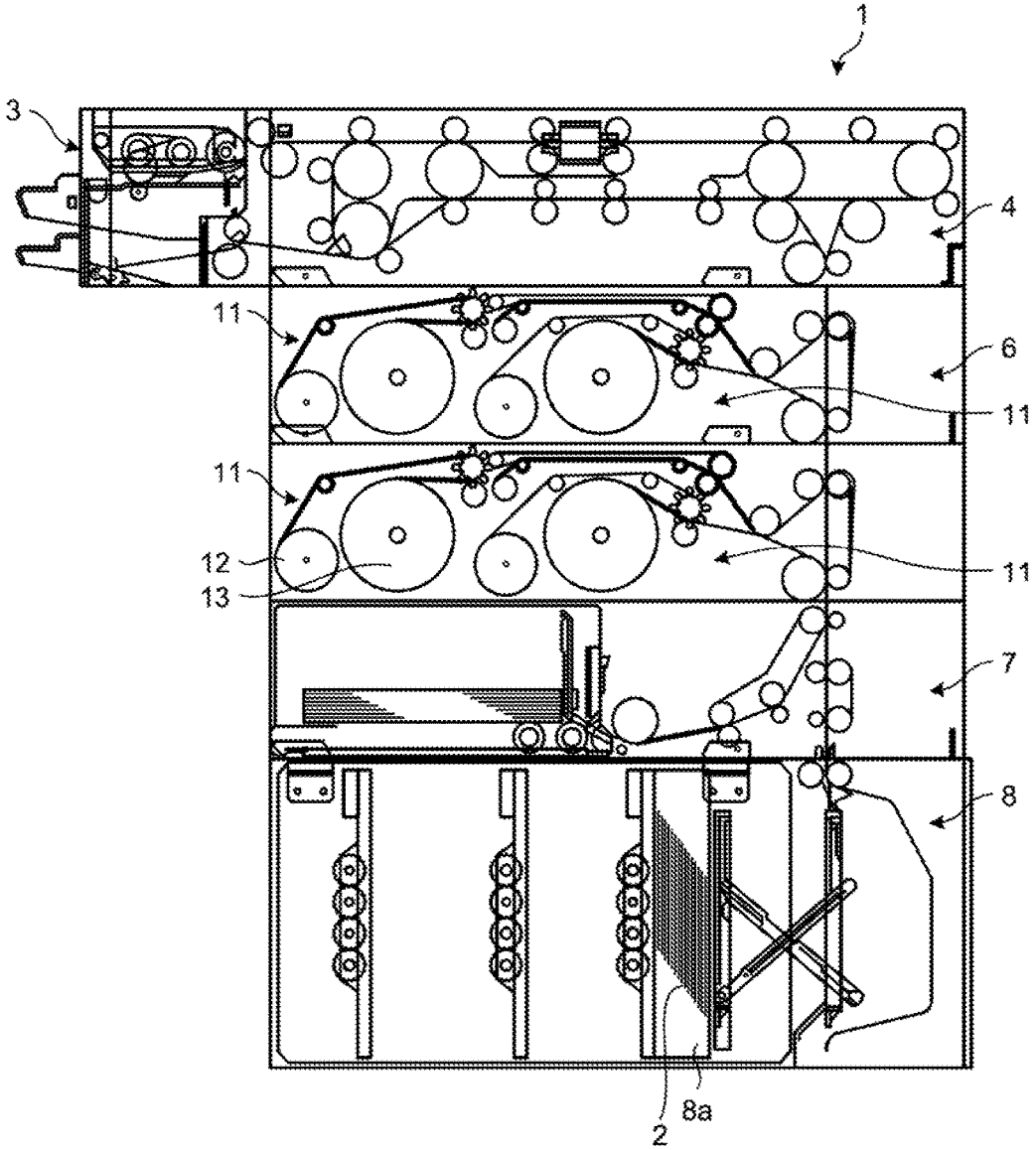
FIG. 1 is a schematic view illustrating an entire banknote handling device including a banknote storage device according to a first embodiment.

FIG. 1 is a schematic diagram illustrating an entire banknote handling device including a banknote storage device according to a first embodiment. As illustrated in FIG. 1, a banknote handling device 1 according to the embodiment includes a loading and unloading unit 3 that loads and unloads banknotes 2, a discrimination unit 4 that discriminates the banknotes 2 loaded into the loading and unloading unit 3, and a temporary storage unit 11 that temporarily stores the banknotes 2 conveyed from the discrimination unit 4. The banknote handling device 1 further includes a circulation unit 6 that circulates the banknotes 2 stored in the temporary storage unit 11, an unloading unit 7 in which the banknotes 2 to be unloaded are stored, a storage unit 8 that stores the banknotes 2 in a storage 8*a*. The temporary storage unit 11 incorporated into the banknote handling device 1, corresponds to the banknote storage device according to the embodiment. In the present embodiment, although the banknote 2 is used as an example of a paper sheet, the paper sheet is not limited to the banknote.

[Configuration of Banknote Storage Device]

Figure 2:
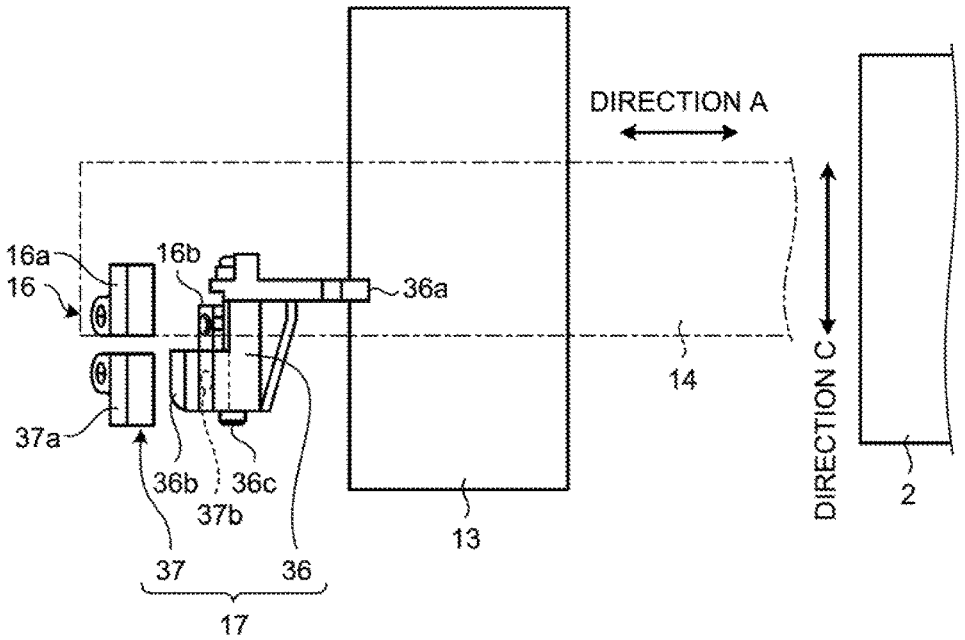
FIG. 2 is a plan view illustrating the banknote storage device according to the first embodiment.
Figure 3:
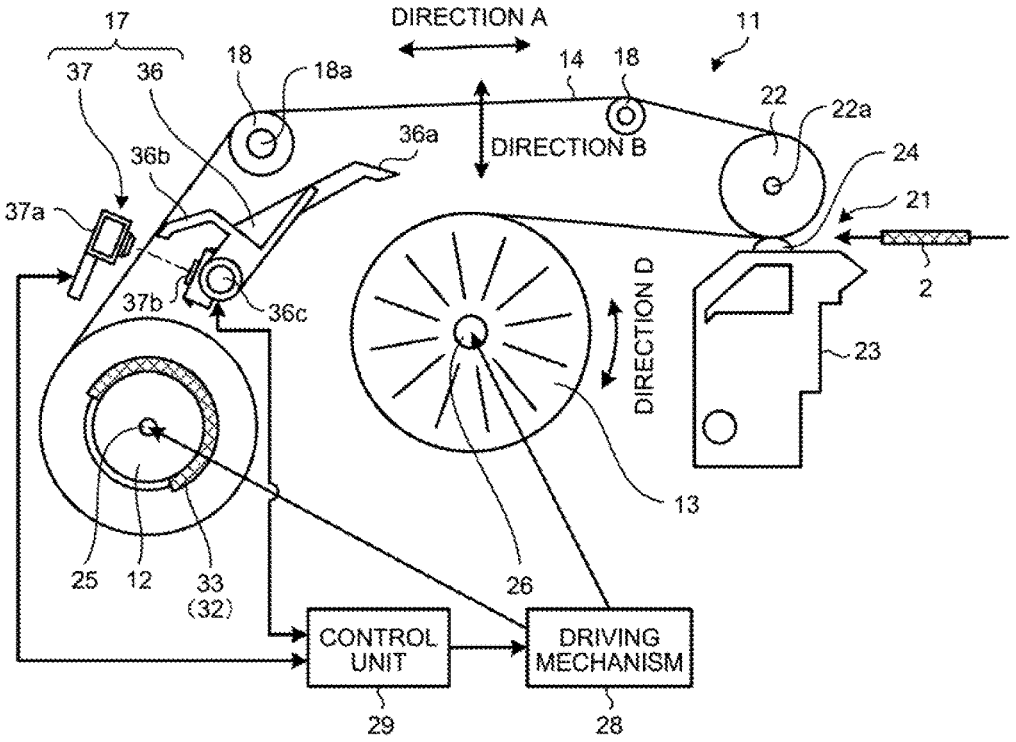
FIG. 3 is a side view schematically illustrating the banknote storage device according to the first embodiment.
Figure 4:
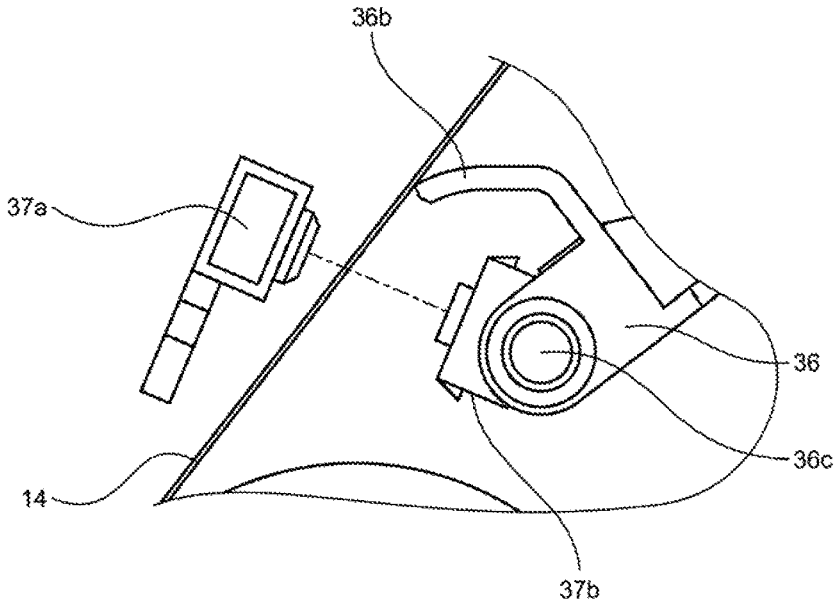
FIG. 4 is a side view illustrating a second detection unit of the banknote storage device according to the first embodiment illustrated in FIG. 3 at an enlarged scale.

FIG. 2 is a plan view illustrating the banknote storage device according to the first embodiment. FIG. 3 is a side view schematically illustrating the banknote storage device according to the first embodiment. FIG. 4 is a side view illustrating a second detection unit of the banknote storage device according to the first embodiment illustrated in FIG. 3 at an enlarged scale.

As illustrated in FIGS. 2 and 3, the banknote storage device 11 according to the first embodiment includes a supply reel 12, a winding drum 13, a first detection unit 16, and a second detection unit 17. The supply reel 12 supplies a tape 14 as a rolled belt-like member. The banknotes 2 are wound around the winding drum 13 together with the tape 14 supplied from the supply reel 12. The first detection unit 16 detects a supply amount of the tape 14 supplied from the supply reel 12. As illustrated in FIGS. 3 and 4, the second detection unit 17 detects the winding drum 13 of which the outer diameter becomes equal to or larger than a predetermined outer diameter (hereinafter referred to as a winding diameter) when the banknotes 2 are wound around the winding drum 13 together with the tape 14.

In the first embodiment, although the narrow tape 14 is used as an example of the belt-like member, the belt-like member is not limited to the tape. Moreover, in the embodiment, although the tape 14 formed of a resin film is used, the tape 14 is not limited to this but a tape formed of other material may be used as appropriate.

The banknote storage device 11 includes a plurality of guide rollers 18 disposed between the supply reel 12 and the winding drum 13. The plurality of guide rollers 18 forms a conveying path, along which the tape 14 supplied from the supply reel 12 is conveyed to the winding drum 13. The guide roller 18 is rotatably supported by a spindle 18*a*.

As illustrated in FIG. 3, the banknote storage device 11 has a conveying port 21, through which the banknotes 2 wound around the winding drum 13 are conveyed. A pinch roller 22 that forms a conveying path of the tape 14 and a guide member 23 having a guide roller 24, are disposed in the conveying port 21. The pinch roller 22 is rotatably supported by a spindle 22*a*. The banknotes 2 conveyed to the conveying port 21 are loaded in a state of being sandwiched by the pinch roller 22 and the guide roller 24, and are guided toward a circumferential surface of the winding drum 13 by the guide member 23.

The supply reel 12 is supported by a rotating shaft 25, and as illustrated in FIG. 3, is rotated by a driving motor (not illustrated) included in a driving mechanism 28. The driving motor of the driving mechanism 28 is electrically connected to a control unit 29 and is driven by a control unit 29. Moreover, one end of the tape 14 is fixed to the rotating shaft 25 of the supply reel 12. The tape 14 having one end fixed to the rotating shaft 25, is rolled around the rotating shaft 25. The other end of the tape 14 is fixed to the winding drum 13. One end of the tape 14 may be fixed to the inner side of the supply reel 12.

The tape 14 is formed of a resin film having a light transmitting property and has, for example, a thickness of approximately 0.1 mm and a width of approximately 20 mm. As illustrated in FIG. 3, a light blocking film is formed on a starting end 32 and on a terminal end 33 in a longitudinal direction (the direction A) of the tape 14. Therefore, an intermediate portion in the longitudinal direction (direction A) of the tape 14 has a light transmitting property, and the starting end 32 and the terminal end 33 have a light blocking property.

Although not illustrated in the drawings, a spring mechanism including a torsion spring that applies tension to the tape 14, is incorporated into the supply reel 12. Moreover, a torque limiter for making the tension applied to the tape 14 constant, is provided in the rotating shaft 25 of the supply reel 12.

As illustrated in FIG. 3, the tape 14 supplied from the supply reel 12 is conveyed by the guide roller 18 so as to pass near the upper side of the winding drum 13. The tape 14 is wound around the circumferential surface of the winding drum 13 with the conveying direction reversed by the pinch roller 22 of the conveying port 21.

The winding drum 13 is supported by a rotating shaft 26 and is rotated by a driving motor (not illustrated) included in the driving mechanism 28. Moreover, the rotation direction of the driving motor of the driving mechanism 28 is switched between a normal direction and a reverse direction by the control unit 29, whereby the driving motor of the driving mechanism 28 selectively rotates the rotating shaft 25 of the supply reel 12 or the rotating shaft 26 of the winding drum 13 using a transmission mechanism of the driving mechanism 28.

[Configuration of First Detection Unit and Detection of End of Tape]

The first detection unit 16 is disposed near the conveying path of the tape 14 drawn from the supply reel 12, and an optical sensor is used as the first detection unit 16. The optical sensor as the first detection unit 16 has a light emitting unit 16*a*, which emits detection light, and a light receiving unit 16*b*, which receives the detection light emitted by the light emitting unit 16*a*. As illustrated in FIG. 2, the light emitting unit 16*a* and the light receiving unit 16*b* are disposed to face each other in a thickness direction (depicted as the direction B in FIG. 3) of the tape 14 at such an interval that the tape 14 passes therethrough. Moreover, the light emitting unit 16*a* and the light receiving unit 16*b* are disposed at a position adjacent to one end in a width direction (the direction C) of the tape 14. Moreover, as illustrated in FIG. 3, the light emitting unit 16*a* and the light receiving unit 16*b* are electrically connected to the control unit 29, and a detection signal is transmitted from the light receiving unit 16*b* to the control unit 29.

In the first detection unit 16, the starting end 32 and the terminal end 33 of the tape 14 move between the light emitting unit 16*a* and the light receiving unit 16*b* with a winding operation of the supply reel 12 or the winding drum 13 winding the tape 14. In this case, since the intermediate portion in the longitudinal direction (the direction A) of the tape 14 does not block the detection light emitted by the light emitting unit 16*a*, a state, in which the light receiving unit 16*b* receives the detection light, is created. On the other hand, since the starting end 32 and the terminal end 33 of the tape 14 block the detection light emitted by the light emitting unit 16*a*, a state, in which the detection light is not received by the light receiving unit 16*b*, is created. Therefore, the light receiving unit 16*b* detects the positions of the starting end 32 and the terminal end 33 of the tape 14 when the state, in which the detection light is received, is changed to the state, in which the detection light is not received.

Upon detecting the starting end 32 of the tape 14, the first detection unit 16 transmits a detection signal to the control unit 29. Similarly, upon detecting the terminal end 33 of the tape 14, the first detection unit 16 transmits a detection signal to the control unit 29. Based on a detection signal of the terminal end 33 from the first detection unit 16, the control unit 29 stops the driving motor and stops the winding operation of the winding drum 13.

In this manner, when the first detection unit 16 detects both ends of the tape 14 supplied from the supply reel 12, the control unit 29 calculates a supply amount of the tape 14 (that is, the winding amount of the tape 14 wound by the winding drum 13). The control unit 29 performs a predetermined calculation process based on the winding amount of the tape 14 to count the number of banknotes 2 stored in a state of being wound around the winding drum 13.

In the present embodiment, although the starting end 32 and the terminal end 33 of the tape 14 have a light blocking property and the intermediate portion of the tape 14 has a light transmitting property, the tape 14 is not limited to this configuration. Contrary to this configuration, the starting end 32 and the terminal end 33 of the tape 14 may have a light transmitting property, and the intermediate portion of the tape 14 may have a light blocking property. In this case, it is also possible to detect the starting end and the terminal end similarly to the present embodiment. Moreover, a reflection sheet may be used instead of the light blocking film formed on the starting end 32 and the terminal end 33 of the tape 14.

In the present embodiment, although the first detection unit 16 is configured using an optical sensor, a rotary encoder, which detects a rotation amount of the rotating shafts 25 and 26 of the supply reel 12 and the winding drum 13, may be used.

[Configuration of Second Detection Unit and Detection of Winding Diameter of Winding Drum]

Figure 5:
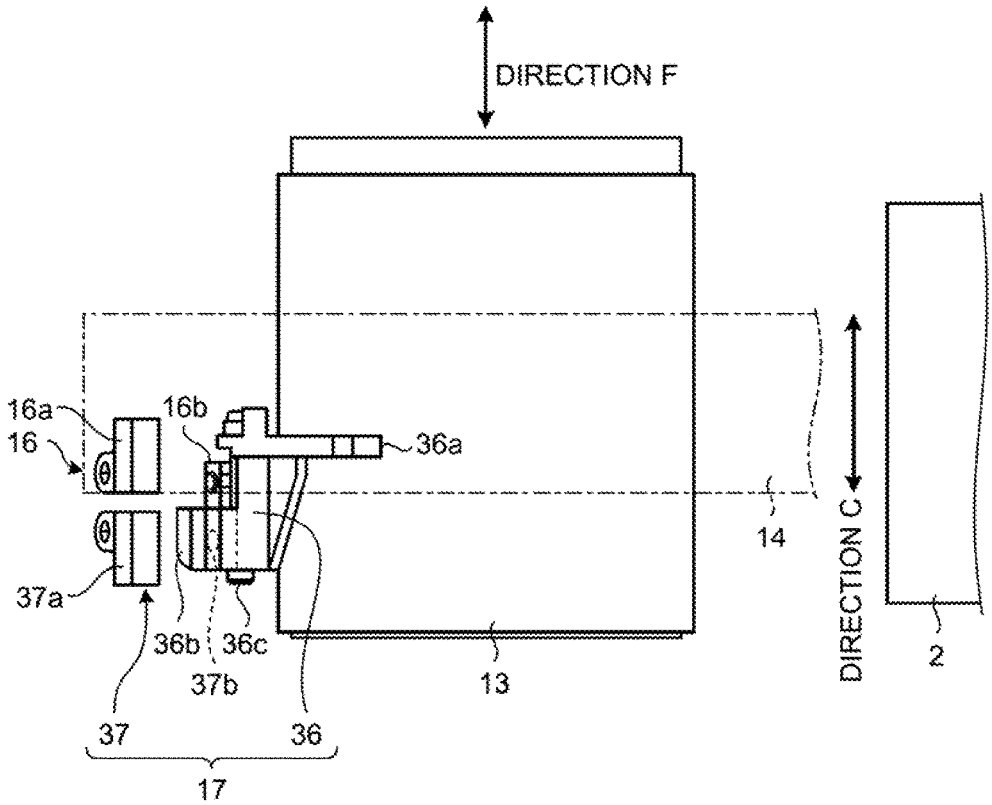
FIG. 5 is a plan view illustrating a state in which a winding drum has a predetermined winding diameter or larger in the banknote storage device according to the first embodiment.
Figure 6:
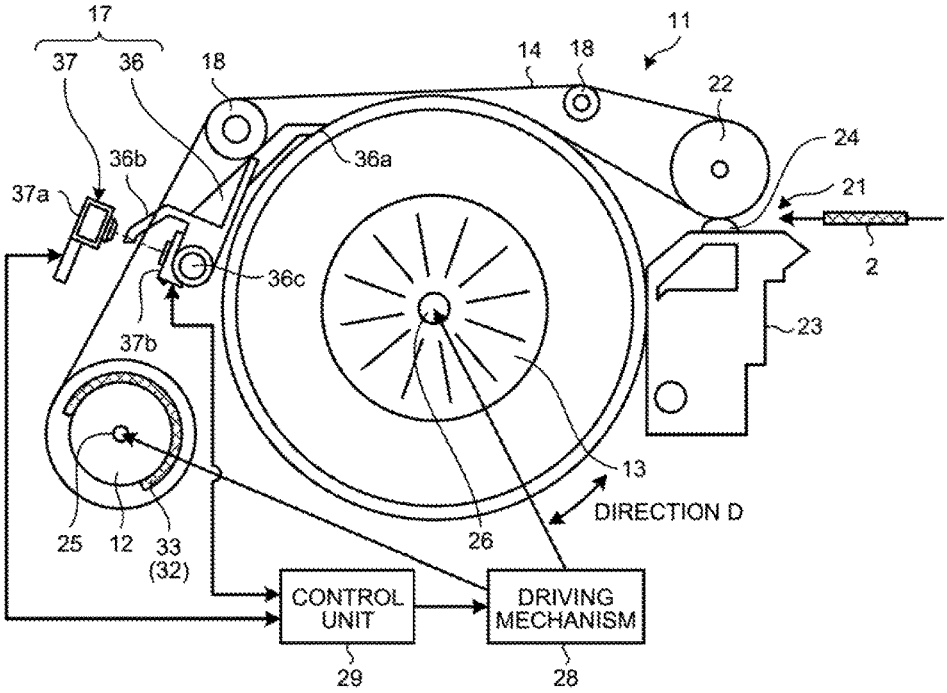
FIG. 6 is a side view illustrating a state in which a winding drum has a predetermined winding diameter or larger in the banknote storage device according to the first embodiment.
Figure 7:
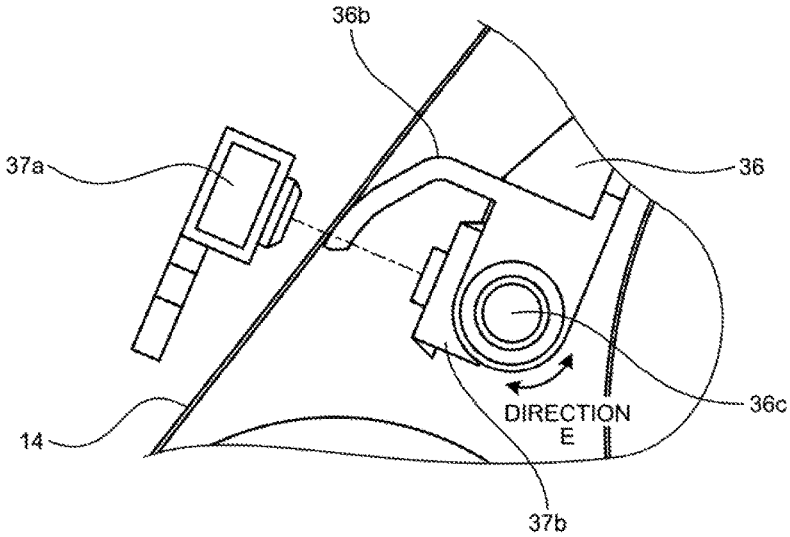
FIG. 7 is a side view illustrating a second detection unit of the banknote storage device according to the first embodiment illustrated in FIG. 6 at an enlarged scale.

FIG. 5 is a plan view illustrating a state in which the winding drum 13 has a predetermined winding diameter or larger in the banknote storage device 11 of the first embodiment. FIG. 6 is a side view illustrating a state in which the winding drum 13 has a predetermined winding diameter or larger in the banknote storage device 11 of the first embodiment. FIG. 7 is a side view illustrating the second detection unit 17 of the banknote storage device 11 according to the first embodiment illustrated in FIG. 6 at an enlarged scale.

As illustrated in FIGS. 2 and 5, the second detection unit 17 is disposed at a position adjacent to the first detection unit 16. The second detection unit 17 includes a detection lever 36 as a detection member and includes an optical sensor 37. The detection lever 36 moves in contact with the winding drum 13 when the diameter of the winding drum 13 around which the banknotes 2 are wound together with the tape 14, is equal to or larger than a predetermined winding diameter. The optical sensor 37 detects movement of the detection lever 36.

As illustrated in FIGS. 5 and 6, the detection lever 36 has a contactor 36*a*, which makes contact with the tape 14 wound around the winding drum 13, and a detection piece 36*b*, which is detected by the optical sensor 37, and the detection lever 36 is rotatably supported by a spindle 36*c*.

The detection lever 36 is disposed at a predetermined attitude around the spindle 36*c* so that the contactor 36*a* makes contact with the winding drum 13 of which the outer diameter becomes equal to a predetermined winding diameter. When the detection lever 36 is at an initial position, which is the predetermined attitude, the contactor 36*a* is separated from the winding drum 13 in a radial direction of the winding drum 13. When the diameter of the winding drum 13 becomes equal to or larger than the predetermined winding diameter, the contactor 36*a* makes contact with the tape 14 wound around the winding drum 13. In this way, the contact between the tape 14 and the detection lever 36 is suppressed as much as possible to prevent wearing and damage of the detection lever 36 and the tape 14 to enhance durability. Moreover, the detection lever 36 is biased around the spindle 36*c* by a torsion spring (not illustrated) so that the contactor 36*a* returns to the initial position.

As illustrated in FIGS. 5 and 6, the optical sensor 37 has a light emitting unit 37*a*, which emits detection light, and a light receiving unit 37*b*, which receives the detection light emitted by the light emitting unit 37*a*. As illustrated in FIG. 7, the light emitting unit 37*a* and the light receiving unit 37*b* are disposed to face each other in a radial direction of the spindle 36*c* of the detection lever 36 at such an interval that the detection piece 36*b* of the detection lever 36 can enter. As illustrated in FIG. 5, the light emitting unit 37*a* and the light receiving unit 37*b* are disposed on one end side in the width direction (the direction C) of the tape 14. The light emitting unit 37*a* and the light receiving unit 37*b* are electrically connected to the control unit 29, and a detection signal is transmitted from the light receiving unit 37*b* to the control unit 29.

The predetermined winding diameter of the winding drum 13 is set to such a diameter (outer diameter) that the winding drum 13 does not interfere with other constituent members such as the guide member 23 disposed inside the banknote storage device 11. Particularly, in the present embodiment, the predetermined winding diameter is set to such a diameter that the winding drum 13, around which the banknotes 2 are wound, does not interfere with the conveying path of the tape 14 supplied from the supply reel 12.

The second detection unit 17 transmits a detection signal to the control unit 29 upon detecting the winding drum 13 of which the outer diameter becomes equal to or larger than a predetermined winding diameter when the contactor 36*a* of the detection lever 36 makes contact with the tape 14 wound around the winding drum 13. Based on the detection signal from the second detection unit 17, the control unit 29 stops the driving motor and stops the winding operation of the winding drum 13.

In the banknote storage device 11, when such a worn-out banknote, as described in the related art, is wound around the winding drum 13, the winding diameter of the winding drum 13 may become equal to or larger than an expected winding diameter. In such a case, according to the second detection unit 17, it is possible to stop the winding operation before the winding drum 13 interferes with the conveying path of the tape 14 or another constituent member such as the guide member 23. In this way, it is possible to prevent damage and breakage of the winding drum 13 or the other constituent member to improve the reliability of the winding operation.

Although the second detection unit 17 uses an optical sensor to detect the movement of the detection lever 36, the second detection unit 17 is not limited to the configuration in which the optical sensor is used. The second detection unit 17 may only need to have a configuration that detects the movement of the detection lever 36, and a pressure sensor or a press button switch, that is pressed by the detection lever 36 that moves, may be used. Moreover, a configuration, in which the light emitting unit and the light receiving unit of the optical sensor are disposed at an interval in an axial direction (the direction F) of the winding drum 13 so that the optical axis of the detection light passes through the position of the contactor 36*a* of the detection lever 36 at the initial position, may be employed. According to this configuration, it is possible to optically detect the winding drum 13 of which the outer diameter becomes equal to or larger than the predetermined outer diameter.

[Banknote Storage Operation]

An operation of winding the banknotes 2 around the winding drum 13 together with the tape 14 in the banknote storage device 11, which has such a configuration, will be described.

In FIG. 3, when the winding drum 13 is rotated in the counter-clockwise direction by the driving mechanism 28, the tape 14 is drawn from the supply reel 12 that rotates in the clockwise direction. The tape 14 drawn from the supply reel 12 is conveyed along the conveying path of the guide roller 18 and is wound around the winding drum 13. In this case, the banknotes 2, loaded from the conveying port 21, are conveyed toward the circumferential surface of the winding drum 13 and are wound around the winding drum 13 in a state of being sandwiched between the tape 14 and the circumferential surface of the winding drum 13. The tape 14, wound around the winding drum 13, is wound stably together with the banknotes 2 in a state, in which constant tension is applied by a torsion spring and a torque limiter. The banknotes 2, loaded to the conveying port 21, are sequentially stored by being wound along the circumferential surface of the winding drum 13 together with the tape 14.

Subsequently, when the first detection unit 16 detects the terminal end 33 of the tape 14 or the second detection unit 17 detects the winding drum 13 of which the outer diameter becomes equal to or larger than the predetermined outer diameter, the rotation of the winding drum 13 is stopped by the control unit 29. In this way, the winding drum 13 ends the operation of storing the banknotes 2.

On the other hand, after the driving of the winding drum 13 stops, the control unit 29 switches the rotation direction of the driving motor of the driving mechanism 28 whereby the supply reel 12 is rotated by the driving motor. In FIG. 6, the supply reel 12 is rotated in the counter-clockwise direction whereby the tape 14 is rewound around the supply reel 12. The tape 14 is rewound around the supply reel 12 and the tape 14 is drawn from the winding drum 13, whereby the banknotes 2, wound around the winding drum 13 together with the tape 14, are discharged from the conveying port 21.

The banknote storage method in the banknote storage device 11 of the first embodiment includes a storing step, a first detection step, and a second detection step. In the storing step, the banknotes 2 are wound around the winding drum 13 together with the tape 14 supplied from the supply reel 12 around which the tape 14 is rolled. In the first detection step, the supply amount of the tape 14 supplied from the supply reel 12 is detected. In the second detection step, the winding drum 13, of which the outer diameter becomes equal to or larger than the predetermined outer diameter, is detected.

[Control Based on First and Second Detection Units]

Figure 8:
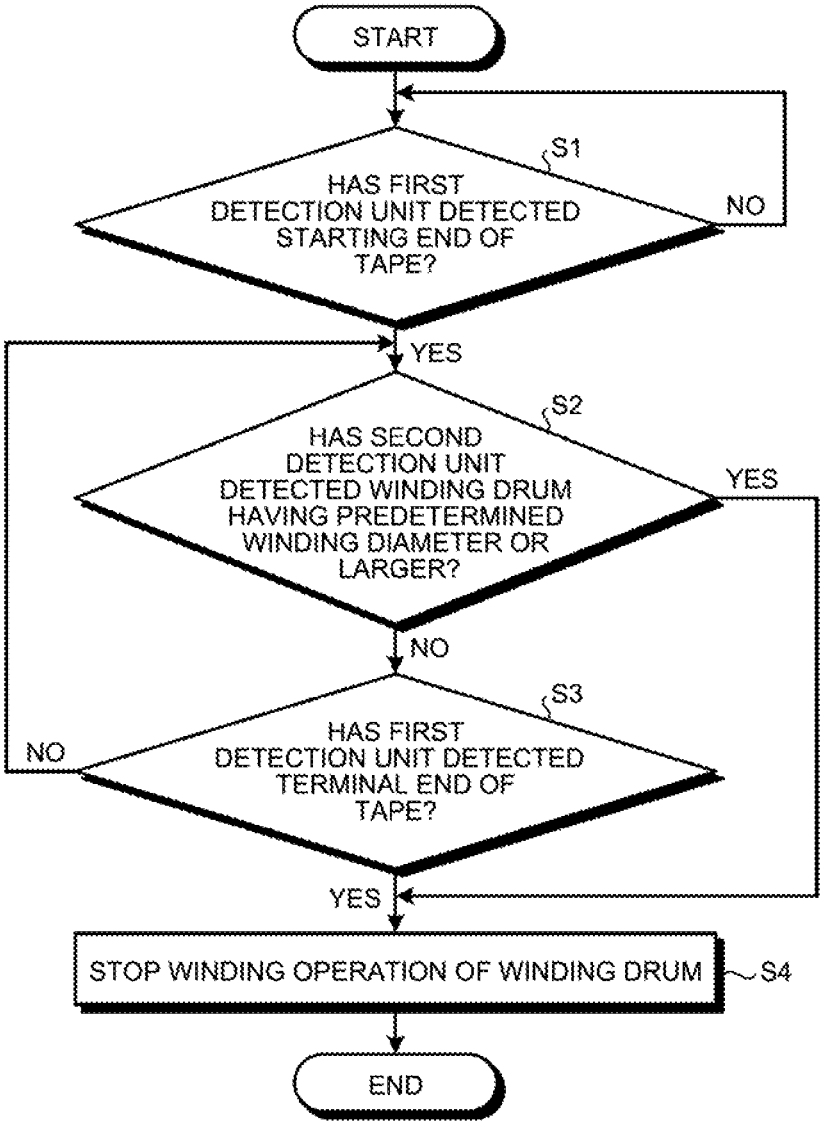
FIG. 8 is a flowchart for describing control that a control unit performs based on the first and second detection units in the banknote storage device according to the first embodiment.

FIG. 8 is a flowchart for describing control that the control unit 29 performs based on the first and second detection units 16 and 17 in the banknote storage device 11 of the first embodiment.

As illustrated in FIG. 8, the winding drum 13 starts an operation of winding the tape 14 and the control unit 29 determines whether the first detection unit 16 has detected the starting end 32 of the tape 14 (step S1). In step S1, when the first detection unit 16 has not detected the starting end 32 of the tape 14, the winding drum 13 continues the operation of winding the tape 14, and the flow returns to step S1. On the other hand, in step S1, when the first detection unit 16 has detected the starting end 32 of the tape 14, the flow proceeds to step S2.

In the banknote storage device 11, after the first detection unit 16 detects the starting end 32 of the tape 14, the banknotes 2, loaded from the conveying port 21, are wound around the winding drum 13 together with the tape 14, whereby storing of the banknotes 2 starts. There is a possibility that during the operation of winding the tape 14 and the banknotes 2, the diameter of the winding drum 13 becomes equal to or larger than the predetermined winding diameter. Due to this, the control unit 29 determines whether the second detection unit 17 has detected the winding drum 13 of which the outer diameter becomes equal to or larger than the predetermined outer diameter during the winding operation (step S2). In step S2, when the second detection unit 17 has detected the winding drum 13, of which the outer diameter becomes equal to or larger than the predetermined outer diameter, the flow proceeds to step S4 to be described later, and the control unit 29 stops the driving motor of the driving mechanism 28. On the other hand, in step S2, when the second detection unit 17 has not detected the winding drum 13, of which the outer diameter becomes equal to or larger than the predetermined outer diameter, the winding operation of the winding drum 13 is continued and the flow proceeds to step S3.

Subsequently, the control unit 29 determines whether the first detection unit 16 has not detected the terminal end 33 of the tape 14 (step S3). In step S3, when the first detection unit 16 has not detected the terminal end 33 of the tape 14, the winding drum 13 continues the operation of winding the tape 14 and the banknotes 2, and the flow returns to step S2. On the other hand, in step S3, when the first detection unit 16 has detected the terminal end 33 of the tape 14, the flow proceeds to step S4, and the control unit 29 stops the driving motor of the driving mechanism 28. In this way, the control unit 29 stops the winding operation of the winding drum 13 (step S4).

[Effects of First Embodiment]

The banknote storage device 11 of the first embodiment includes the supply reel 12, the winding drum 13 around which the banknotes 2 are wound together with the tape 14, the first detection unit 16 that detects the supply amount of the tape 14, and the second detection unit 17 that detects the winding drum 13 of which the outer diameter becomes equal to or larger than the predetermined outer diameter. In this way, the banknote storage device 11 can detect, with the aid of the second detection unit 17, that the diameter of the winding drum 13 becomes equal to or larger than the predetermined outer diameter during the winding operation when a worn-out banknote is wound around the winding drum 13, for example. Therefore, according to the banknote storage device 11, it is possible to prevent the winding drum 13 from interfering with the conveying path of the tape 14 or other constituent members during the winding operation and to prevent damage and breakage of the tape 14, the winding drum 13, and other constituent members. As a result, it is possible to improve the reliability of the winding operation of the winding drum 13.

The second detection unit 17 of the first embodiment includes the detection lever 36 that moves in contact with the winding drum 13 of which the outer diameter becomes equal to or larger than the predetermined outer diameter and the optical sensor 37 that detects the movement of the detection lever 36. In this way, it is possible to detect the winding diameter of the winding drum 13 with a simple configuration and is possible to suppress an increase in the manufacturing cost of the banknote storage device 11.

The detection lever 36 of the second detection unit 17 of the first embodiment is disposed to be separated from the winding drum 13 in the radial direction (the direction D) of the winding drum 13 so as to make contact with the winding drum 13 when the diameter of the winding drum 13 has become equal to or larger than the predetermined outer diameter. In this way, it is possible to suppress the contact between the detection lever 36 and the winding drum 13 as much as possible and is possible to prevent wearing and damage of the detection lever 36 and the tape 14.

In the first embodiment, the conveying path of the tape 14, conveyed from the supply reel 12 to the winding drum 13, passes near the outer diameter of the winding drum 13 around which the tape 14, supplied from the supply reel 12, is wound up to the terminal end 33 in the longitudinal direction (the direction A). Particularly, in a structure in which the size of the conveying path of the tape 14 is reduced, the presence of the second detection unit 17 is highly effective in preventing interference between the winding drum 13 and the conveying path of the tape 14. However, the conveying path of the tape 14 is not limited to such a configuration as illustrated in the first embodiment.

Hereinafter, other embodiments will be described with reference to the drawings. In the other embodiments, the same constituent members, as those of the first embodiment, will be denoted by the same reference numerals as those used in the first embodiment, and the description thereof will not be provided.

Second Embodiment

Figure 9:
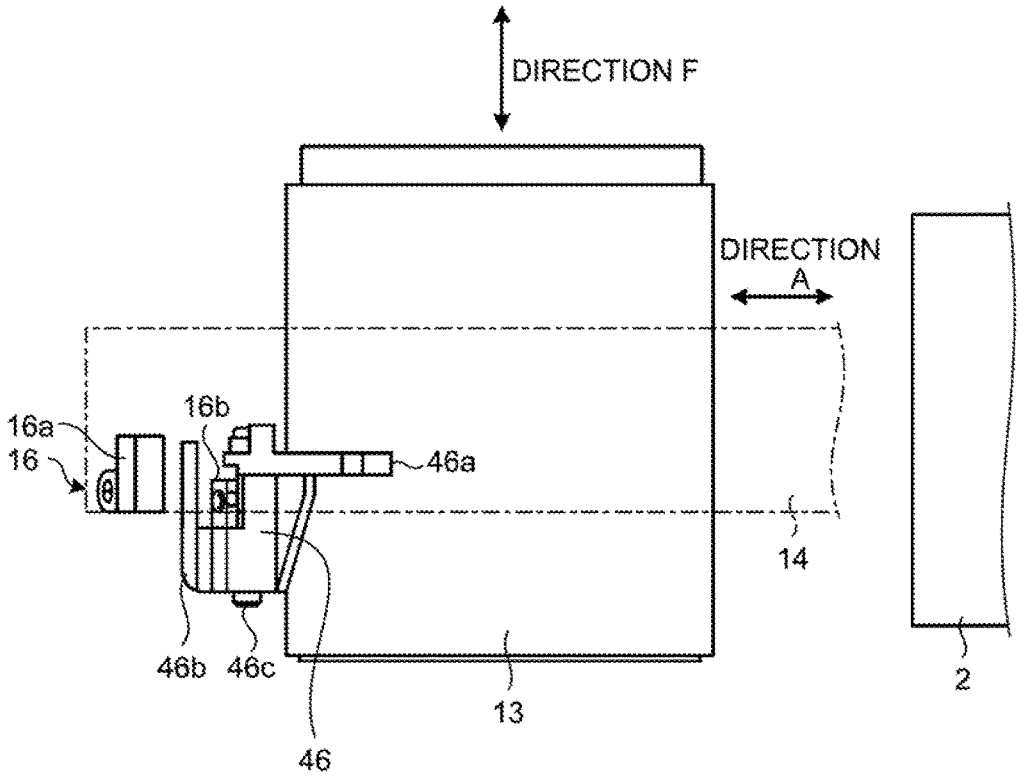
FIG. 9 is a plan view for describing a detection lever of the second detection unit in a banknote storage device according to a second embodiment.

FIG. 9 is a plan view for describing a detection lever of a second detection unit of a banknote storage device according to a second embodiment. The shape of the detection lever according to the second embodiment is different from that of the detection lever 36 according to the first embodiment.

As illustrated in FIG. 9, a detection lever 46 includes a contactor 46*a*, which makes contact with the tape 14 wound around the winding drum 13, and a detection piece 46*b*, which is detected by the light emitting unit 16*a* and the light receiving unit 16*b* of the first detection unit 16, and the detection lever 46 is rotatably supported by a spindle 46*c*. Moreover, the detection lever 46 is biased around the spindle 46*c* by a torsion spring (not illustrated) so that the contactor 46*a* returns to the initial position.

In the detection lever 46 according to the second embodiment, the detection piece 46*b*, as detected the movement by the first detection unit 16, extends up to the vicinity of a position between the light emitting unit 16*a* and the light receiving unit 16*b*. The detection piece 46*b* is disposed such a position that the detection piece 46*b* does not make contact with the tape 14. Moreover, the detection piece 46*b* is formed between the light emitting unit 16*a* and the light receiving unit 16*b* so that, when the contactor 46*a* makes contact with the winding drum 13 and the detection lever 46 is moved, the detection piece 46*b* enters between the light emitting unit 16*a* and the conveying path of the tape 14.

[Effects of Second Embodiment]

The first detection unit 16 of the second embodiment uses an optical sensor that optically detects an end in the longitudinal direction (the direction A) of the tape 14. The optical sensor of the first detection unit 16 is the same member as the optical sensor 37 of the second detection unit 17. That is, the movement of the detection lever 46 of the second detection unit 17 is detected using the light emitting unit 16*a* and the light receiving unit 16*b* of the first detection unit 16. In this way, since the first detection unit 16 also serves as the optical sensor 37 of the second detection unit 17, the optical sensor is shared, and the optical sensor 37 of the second detection unit 17 of the first embodiment can be omitted. As a result, according to the second embodiment, it is possible to simplify the configuration of the second detection unit 17, to reduce the manufacturing cost, and to reduce the size of the entire banknote storage device 11. Moreover, in the second embodiment, it is possible to prevent damage and breakage of the tape 14, the winding drum 13, and the like and to improve the reliability of the winding operation of the winding drum 13 similarly to the first embodiment.

Third Embodiment

Figure 10:
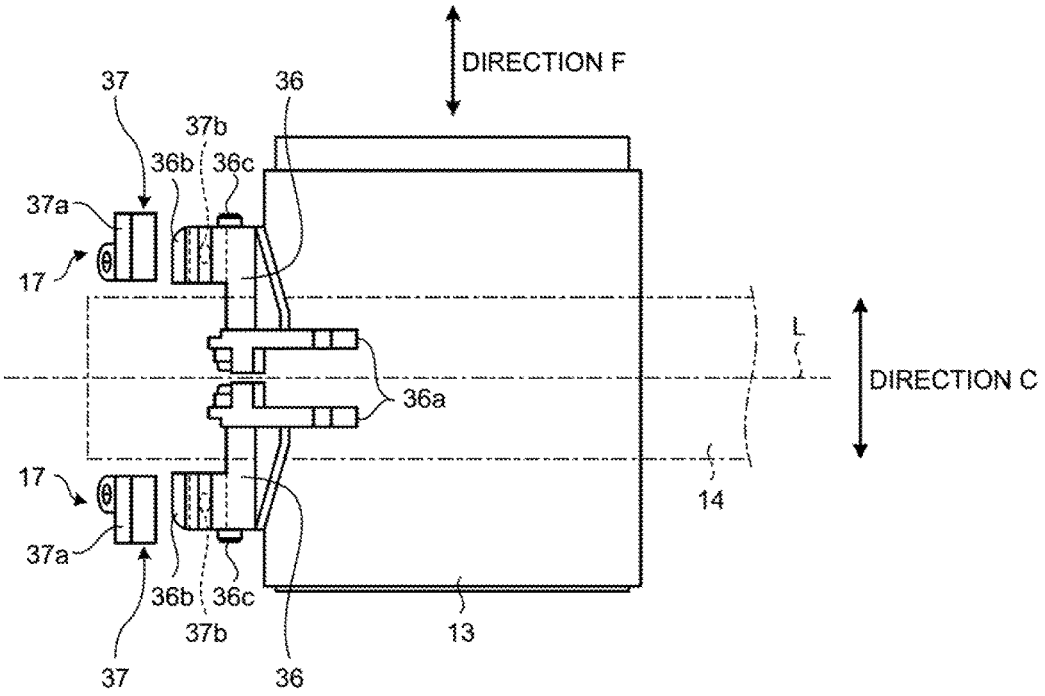
FIG. 10 is a plan view for describing a detection lever of the second detection unit in a banknote storage device according to a third embodiment.

FIG. 10 is a plan view for describing a detection lever of the second detection unit in the banknote storage device of a third embodiment. The third embodiment is different from the first embodiment in that the winding drum 13, of which the outer diameter becomes equal to or larger than the predetermined outer diameter, is detected using a plurality of second detection units.

As illustrated in FIG. 10, in the third embodiment, a set of second detection units 17 is disposed linearly symmetrical with respect to a central line L of the width direction (the direction C) of the tape 14. Each detection lever 36 is disposed at an interval in the width direction (the direction C) of the tape 14 wound around the winding drum 13, and each contactor 36*a* is disposed along the width direction (the direction C) of the tape 14. Due to this, at least one contactor 36*a* of each detection lever 36 of one set of first detection units 16 makes contact with the tape 14 wound around the winding drum 13, whereby the winding drum 13, of which the outer diameter becomes equal to or larger than the predetermined outer diameter, is detected.

[Effects of Third Embodiment]

For example, when the circumferential surface of the winding drum 13 is inclined in an axial direction (the direction F) due to an inclination or the like of the rotating shaft 26 of the winding drum 13, the winding diameter of the winding drum 13 is biased in the axial direction (the direction F) of the winding drum 13. In such a case, at least one of the contactors 36*a* of the plurality of detection levers 36 makes contact with the tape 14 wound around the winding drum 13 whereby the winding drum 13, of which the outer diameter becomes equal to or larger than the predetermined outer diameter, can be detected. Due to this, according to the third embodiment, it is possible to improve the detection accuracy of the winding diameter of the winding drum 13. Therefore, in the third embodiment, it is possible to prevent damage and breakage of the tape 14, the winding drum 13, and the like and to improve the reliability of the winding operation of the winding drum 13 similarly to the first and second embodiments.

Fourth Embodiment

Figure 11:
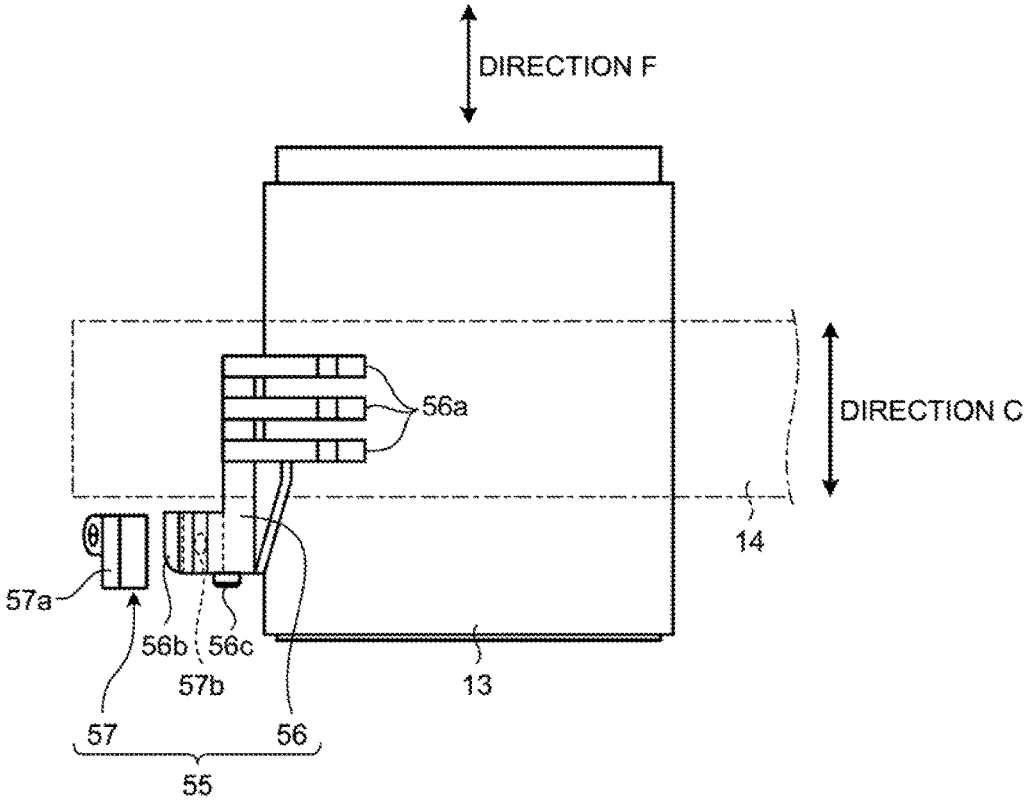
FIG. 11 is a plan view for describing a detection lever of the second detection unit in a banknote storage device according to a fourth embodiment.
Figure 12A:
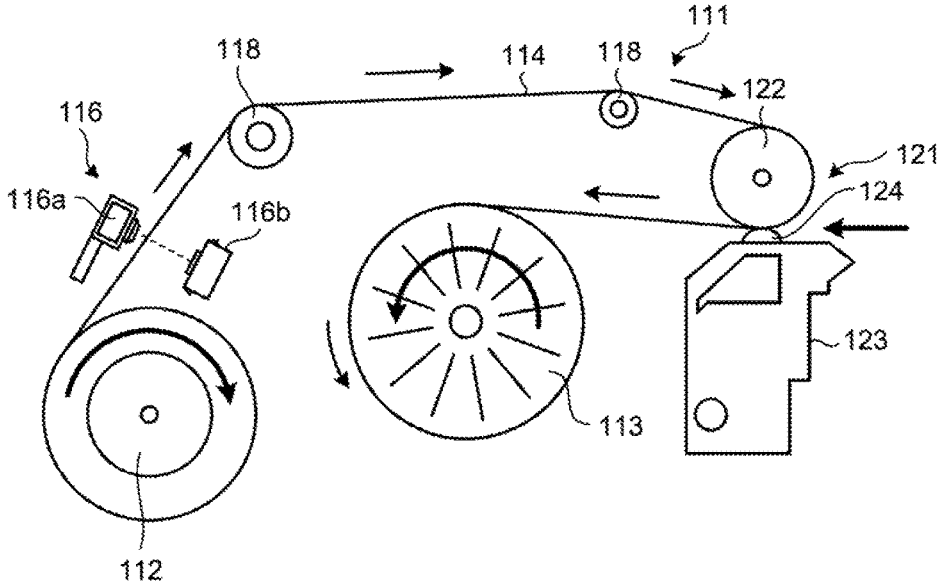
FIG. 12A is a schematic side view for describing a state in which a winding drum winds banknotes together with a tape in a banknote storage device according to a related art of the present application.
Figure 12B:
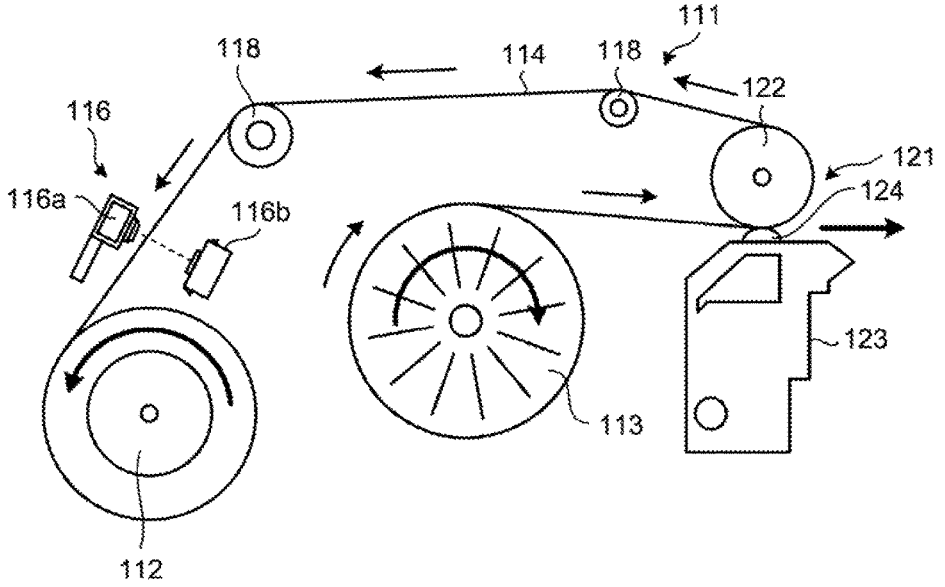
FIG. 12B is a schematic side view for describing a state in which a supply reel rewinds a tape in the banknote storage device according to the related art of the present application.
Figure 13A:
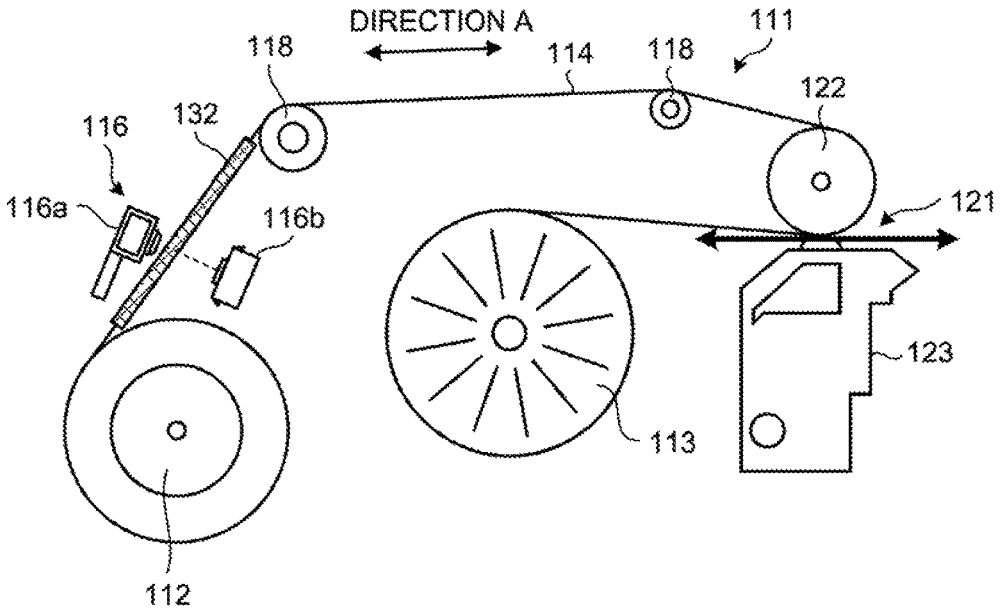
FIG. 13A is a schematic side view for describing a state in which a starting end of a tape is detected in a banknote storage device according to the related art of the present application.
Figure 13B:
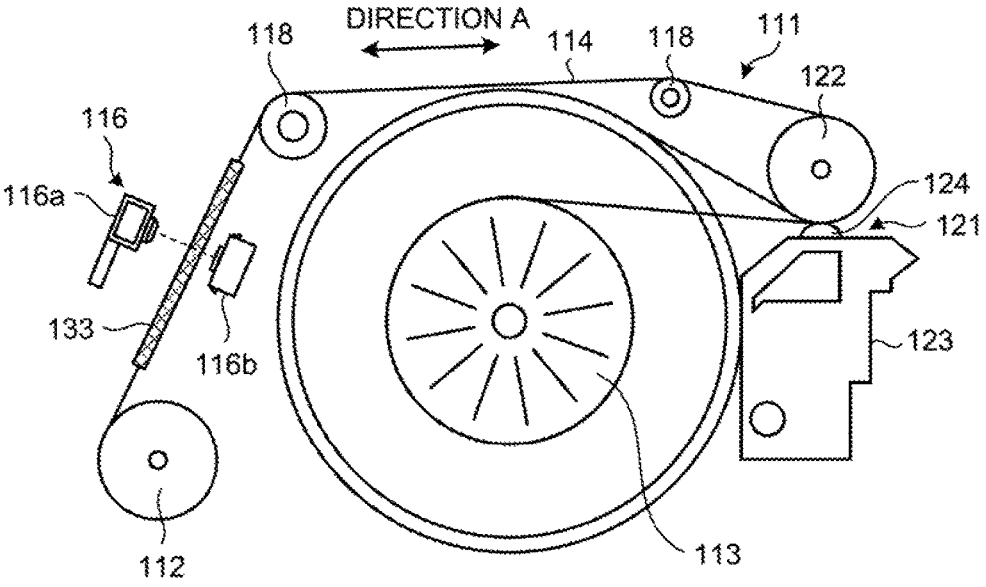
FIG. 13B is a schematic side view for describing a state in which a terminal end of the tape is detected in the banknote storage device according to the related art of the present application.
Figure 13C:
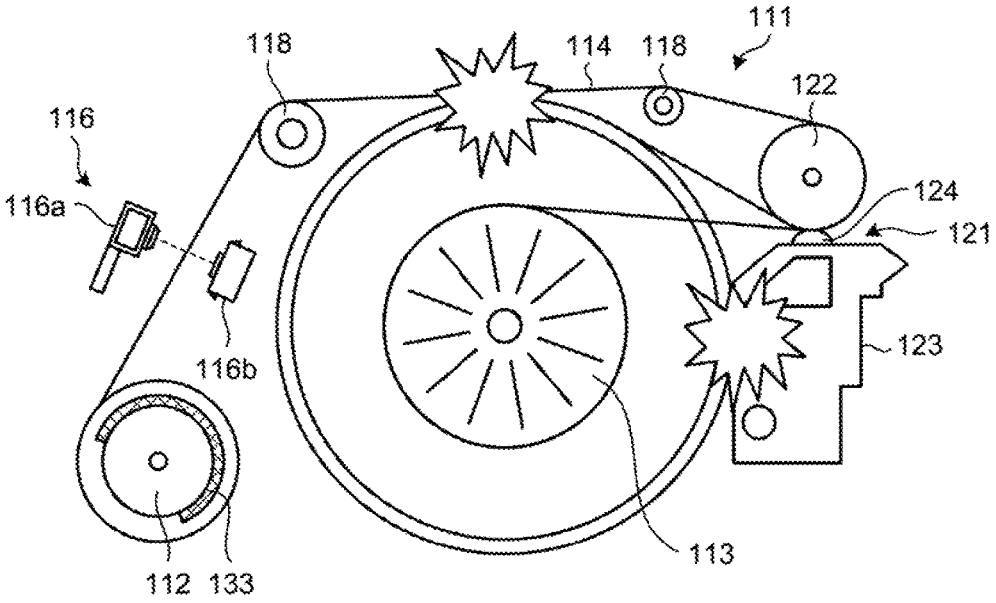
FIG. 13C is a schematic side view for describing a state in which a winding drum of which the outer diameter becomes equal to or larger than a predetermined winding diameter interferes with a conveying path of the tape in the banknote storage device according to the related art of the present application.

FIG. 11 is a plan view for describing a detection lever of the second detection unit in the banknote storage device of a fourth embodiment. The fourth embodiment is different from the first embodiment in that one detection lever has a plurality of contactors.

As illustrated in FIG. 11, a second detection unit 55 according to the fourth embodiment includes a detection lever 56 and an optical sensor 57. The detection lever 56 moves in contact with the winding drum 13 when the diameter, of the winding drum 13 wound around the banknotes 2 together with the tape 14, becomes equal to or larger than a predetermined winding diameter. The optical sensor 57 has a light emitting unit 57*a*, which emits detection light, and a light receiving unit 57*b*, which receives the detection light emitted by the light emitting unit 57*a*, and the optical sensor 57 detects the movement of the detection lever 56.

The detection lever 56 has a plurality of contactors 56*a*, which makes contact with the tape 14 wound around the winding drum 13, and a detection piece 56*b* which is detected by an optical sensor 57, and the detection lever 56 is rotatably supported by a spindle 56*c*. Moreover, the detection lever 56 is biased around the spindle 56*c* by a torsion spring (not illustrated) so that the plurality of contactors 56*a* returns to an initial position.

The contactors 56*a* of the detection lever 56 are disposed at an interval along the width direction (the direction C) of the tape 14 wound around the winding drum 13. Due to this, the detection lever 56 detects the winding drum 13 of which the outer diameter becomes equal to or larger than the predetermined outer diameter when at least one of the plurality of contactors 56*a* makes contact with the tape 14 wound around the winding drum 13.

[Effects of Fourth Embodiment]

The detection lever 56 of the second detection unit 55 according to the fourth embodiment has the plurality of contactors 56*a* that makes contact with the winding drum 13, and the plurality of contactors 56*a* is disposed along the width direction (the direction C) of the tape 14 wound around the winding drum 13. Due to this, it is possible to cope with a case in which the winding diameter of the winding drum 13 is biased in the axial direction (the direction F) of the winding drum 13. That is, in such a case, it is possible to detect the winding drum 13 of which the outer diameter becomes equal to or larger than the predetermined outer diameter when at least one of the contactors 56*a* of the plurality of detection levers 56 makes contact with the tape 14 wound around the winding drum 13. Due to this, according to the fourth embodiment, it is possible to improve the detection accuracy of the winding diameter of the winding drum 13 similarly to the third embodiment. Therefore, in the fourth embodiment, it is possible to prevent damage and breakage of the tape 14, the winding drum 13, and the like, and to improve the reliability of the winding operation of the winding drum 13 similarly to the first, second, and third embodiments.

Although not illustrated in the drawings, a configuration, in which a plurality of detection levers each having a plurality of contactors is disposed in the width direction (the direction C) of the tape 14 wound around the winding drum 13, may be employed as appropriate. Moreover, although the detection lever of the embodiment is disposed at such a position as to make contact with the tape 14 wound around the winding drum 13, the detection lever may be disposed so as to make contact with the banknote 2 wound around the winding drum 13 as appropriate. However, a configuration, in which the detection lever makes contact with the tape 14, is preferable from the perspective of preventing damage and breakage of the banknotes 2.

The present embodiment may be applied to a configuration in which banknotes are wound around the winding drum together with two tapes while the banknotes are sandwiched between the facing tapes supplied from two supply reels. Moreover, the present embodiment may be applied to a configuration in which banknotes are wound around the winding drum together with a plurality of tapes arranged in parallel in the axial direction (the direction F) of the winding drum.

According to an aspect of the paper sheet storage device disclosed in the present application, it is possible to prevent breakage of a winding drum and the other constituent members and increase the reliability of a winding operation of the winding drum.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet storage device comprising:

a supply reel that supplies a rolled belt-like member;

a winding drum around which a paper sheet is wound together with the belt-like member supplied from the supply reel;

a first detection unit that has a sensor for optically detecting a change into a light blocking state at an end of the belt-like member in a longitudinal direction, and that detects a supply amount of the belt-like member supplied from the supply reel; and a second detection unit that detects the winding drum of which the outer diameter becomes equal to or larger than a predetermined outer diameter when the paper sheet is wound around the winding drum together with the belt-like member, wherein the second detection unit is combined with the first detection unit, and includes a detection member having a detection piece that moves by the detection piece coming into contact with the winding drum having an outer diameter equal to or larger than the predetermined outer diameter, and a spindle that supports the sensor of the first detection unit and rotatably supports the detection member, and the movement of the detection piece of the detection member is detected by the sensor of the first detection unit, wherein the detection member is disposed to be separated from the winding drum in a radial direction of the winding drum so that the detection member makes contact with the winding drum when the outer diameter of the winding drum becomes equal to or larger than the predetermined outer diameter, and the sensor has a light emitting unit and a light receiving unit, one of the light emitting unit and the light receiving unit being disposed near the spindle, and the light emitting unit and the light receiving unit being disposed to face each other in a radial direction of the spindle at such an interval that the detection piece can enter.

2. The paper sheet storage device according to claim 1, wherein the detection member of the second detection unit has a plurality of contactors, which makes contact with the winding drum, and the plurality of contactors is disposed along a width direction of the belt-like member wound around the winding drum.

3. The paper sheet storage device according to claim 1, wherein a conveying path of the belt-like member conveyed from the supply reel to the winding drum passes near the outer diameter of the winding drum around which the belt-like member supplied from the supply reel is wound up to a terminal end in a longitudinal direction of the belt-like member.

4. A paper sheet storage method comprising:

winding a paper sheet around a winding drum together with a belt-like member supplied from a supply reel around which the belt-like member is rolled;

detecting a supply amount of the belt-like member supplied from the supply reel, by using a first detection unit having a sensor for optically detecting a change into a light blocking state at an end of the belt-like member in a longitudinal direction; and detecting, by using a second detection unit combined with the first detection unit, the winding drum of which the outer diameter becomes equal to or larger than a predetermined outer diameter when the paper sheet is wound around the winding drum together with the belt-like member, the second detection unit including a detection member that moves in contact with the winding drum having an outer diameter equal to or larger than the predetermined outer diameter, with which movement to be detected by the sensor, wherein the detection member has a detection piece to be detected by the sensor, and is rotatably supported by a spindle which supports the sensor and disposed to be separated from the winding drum in a radial direction of the winding drum so that the detection member makes contact with the winding drum when the outer diameter of the winding drum becomes equal to or larger than the predetermined outer diameter, and the sensor has a light emitting unit and a light receiving unit, one of the light emitting unit and the light receiving unit being disposed near the spindle, and the light emitting unit and the light receiving unit being disposed to face each other in a radial direction of the spindle at such an interval that the detection piece can enter.

* * * * *